United States Patent [19]

Watanabe

[11] Patent Number: 4,642,456

[45] Date of Patent: Feb. 10, 1987

[54] DOUBLE SHEET DETECTION METHOD AND APPARATUS OF SHEET-FED ROTARY PRESS

[75] Inventor: Hideo Watanabe, Abiko, Japan

[73] Assignee: Komori Printing, Tokyo, Japan

[21] Appl. No.: 715,311

[22] Filed: Mar. 25, 1985

[51] Int. Cl.[4] ..... G01N 9/04; G06M 7/00

[52] U.S. Cl. ..... 250/223 R; 356/443

[58] Field of Search ..... 250/223 R, 559, 562, 250/563, 571, 572, 223 B; 356/443, 444, 434; 222/415, 371

[56] References Cited

U.S. PATENT DOCUMENTS 3,614,419 10/1971 Daughton ..... 250/223 R 4,237,378 12/1980 Jones ..... 250/223 R

*Primary Examiner*—David C. Nelms

*Assistant Examiner*—William L. Oen

*Attorney, Agent, or Firm*—Townsend & Townsend

[57] ABSTRACT

A double sheet detection method and apparatus for a sheet-fed rotary press is proposed wherein a theoretical reference value is set as a difference between an intermediate value between a first theoretical amount of light transmitted through one sheet and a second theoretical amount of light transmitted through two sheets and the first theoretical amount of light; the theoretical reference value is stored in correspondence with the amount of light transmitted through a sheet; a difference is calculated between an amount of light transmitted through an nth sheet and an amount of light transmitted through an (n+1)th sheet when actual printing is performed; the theoretical reference value which corresponds to the amount of light transmitted through the nth sheet and which is defined as an actual reference value is read out; the difference calculated when actual printing is performed is compared with the actual reference value; and double sheet detection is performed in accordance with a comparison result.

6 Claims, 10 Drawing Figures

DOUBLE SHEET DETECTION METHOD AND APPARATUS OF SHEET-FED ROTARY PRESS

BACKGROUND OF THE INVENTION

The present invention relates to double sheet detection method and apparatus of a sheet-fed rotary press.

In conventional sheet-fed rotary presses, when two sheets are simultaneously fed to a feedboard, they are detected through a through hole of the feedboard by a photodetector consisting of a light source and a photosensor so as to stop the operation of the press. Conventional detecting methods are shown in FIGS. 1 to 3, respectively.

FIGS. 1 to 3 are graphs each of which shows the relationship between a transmittance $\alpha$ of light through a sheet and an amount D of light transmitted therethrough. It should be noted that the amount of light is expressed as a percentage where an amount of light which corresponds to 100% of the transmittance is given to be 100%. The transmittance $\alpha$ and the amount D have a linear relationship ($D=\alpha$) when one sheet is subjected to detection, as indicated by a line A. However, the transmittance $\alpha$ and the amount D have a nonlinear relationship ($D=\alpha^2$) when two sheets are subjected to detection. When the sheets have the same quality and thickness, the amount of light transmitted through one sheet is greater than that transmitted through two sheets. Double sheet detection is performed in accordance with a difference between these amounts.

According to the method shown in FIG. 1, a detection level Ld is fixed in accordance with the types (thickness and quality) of sheet. In other words, each detection level is given for the corresponding type of sheet. A detectable range DE of this method is very narrow, and the detection level must be reset in accordance with each different type of sheet. In addition to these disadvantages, changes in various conditions over time cannot be compensated for by this method.

In the method shown in FIG. 2, the previous amounts of light transmitted through the given type of sheets are averaged. Data representing an average amount of light is stored in a memory, and a detection level Ld is determined in accordance with this data. In comparison with the method shown in FIG. 1, a detectable range DE of the second method can be greatly increased. However, when a transmittance is close to 0% or 100%, double sheet detection cannot be performed.

In the method shown in FIG. 3, a detection level Ld is determined by multiplying a given ratio with the data stored in the second method. A detectable range DE of the third method is wider than that of the second method. However, when a transmittance is close to 100%, double sheet detection cannot be performed.

In order to solve the above problems, still another conventional method is proposed in Japanese Patent Disclosure No. 57-214994 entitled "Double sheet detection method and apparatus for sheet-fed rotary press" of the same applicant as that of the present invention, wherein double sheet detection can be performed in accordance with an optical reference value which can be automatically set even if a transmittance substantially varies from 0% to 100%. This method comprises the steps of: setting a theoretical reference value as an intermediate value between a first theoretical amount of light transmitted through one sheet and a second theoretical amount of light transmitted through two sheets, respectively; subtracting the theoretical reference value from the first amount of light to obtain a theoretical subtracted value; subtracting the theoretical subtracted value from an actual amount of light transmitted through one sheet to obtain an actual reference value; and comparing an actual amount of light transmitted through a current sheet with the actual reference value to perform double sheet detection. According to this method, the actual reference value and the amount of light transmitted through the sheet are considerably large values. In this sense, a comparator must have a wide input range, resulting in high cost.

SUMMARY OF THE INVENTION

It is, therefore, a principal object of the present invention to provide a double sheet detection method, wherein double sheet detection can be effectively performed with a compact arrangement at low cost.

It is still another object of the present invention to provide a compact, low-cost double sheet detection apparatus utilizing the above method.

According to an aspect of the present invention, there is provided a double sheet detection method for a sheet-fed rotary press, comprising the steps of:

setting a theoretical reference value as a difference between an intermediate value between a first theoretical amount of light transmitted through one sheet and a second theoretical amount of light transmitted through two sheets and the first theoretical amount of light;

storing the theoretical reference value in correspondence with the amount of light transmitted through a sheet;

calculating a difference between an amount of light transmitted through an nth sheet and an amount of light transmitted through an (n+1)th sheet when actual printing is performed;

reading out the theoretical reference value which corresponds to the amount of light transmitted through the nth sheet and which is defined as an actual reference value;

comparing the difference obtained in the calculating step with the actual reference value; and performing double sheet detection in accordance with a comparison result.

According to another aspect of the present invention, there is provided a double sheet detection apparatus for a sheet-fed rotary press, comprising:

a light-emitting element and a light-receiving element, opposing each other through a sheet, for generating an analog signal representing an amount of light received;

a processing section for receiving the analog signal from the light-receiving element and converting the analog signal into a digital signal;

a memory for receiving the digital signal from the processing section and storing the digital signal therein;

an operation circuit for receiving the digital signals from the memory and the processing section and calculating a difference therebetween;

a reference value generator for storing a difference between an intermediate value between amounts of light transmitted through one sheet and two sheets and the amount of light transmitted through one sheet and generating the difference value as a reference value in response to the digital signal from the memory;

a comparator for receiving and comparing output signals from the reference value generator and the operation circuit and for generating a signal representing a comparison result;

an output circuit for generating as a double sheet detection signal the signal generated from the comparator; and a timing signal generator for supplying timing signals for controlling operation timings of the processing section, the memory, the reference value generator and the output circuit.

DESCRIPTION OF THE PREFERRED EMBODIMENT

In order to best understand the present invention, the principle of double sheet detection according to the present invention will be described with reference to FIG. 4.

Figure 2:
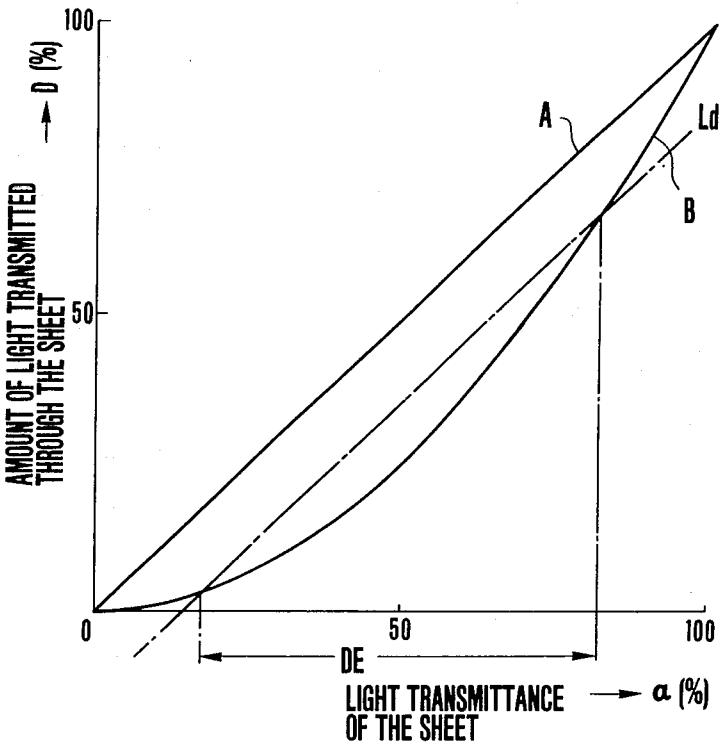
FIG. 2 PRIOR ART
FIGS. 1 to 3 are graphs showing the principles of double sheet detection according to conventional methods, respectively.
Figure 1:
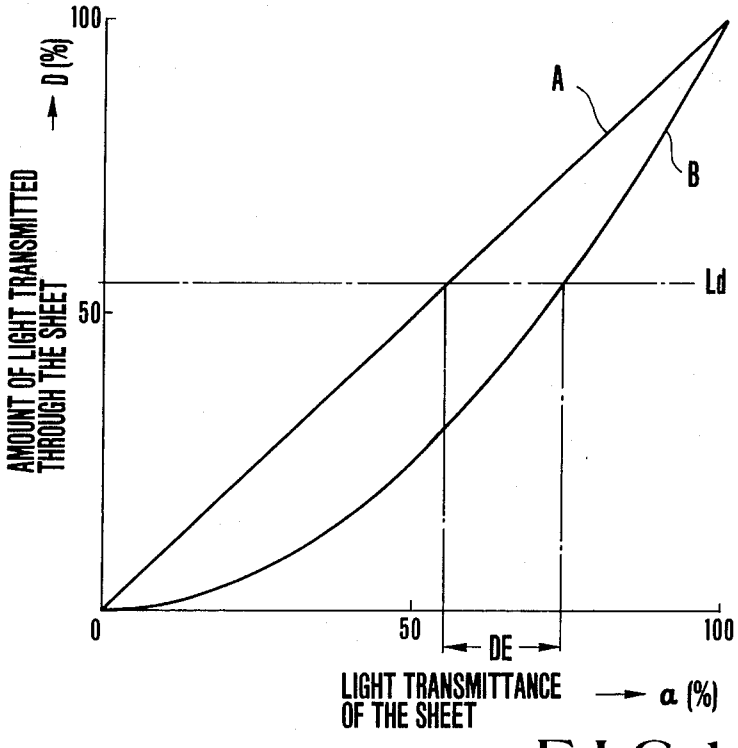
FIG. 1 PRIOR ART
Figure 4:
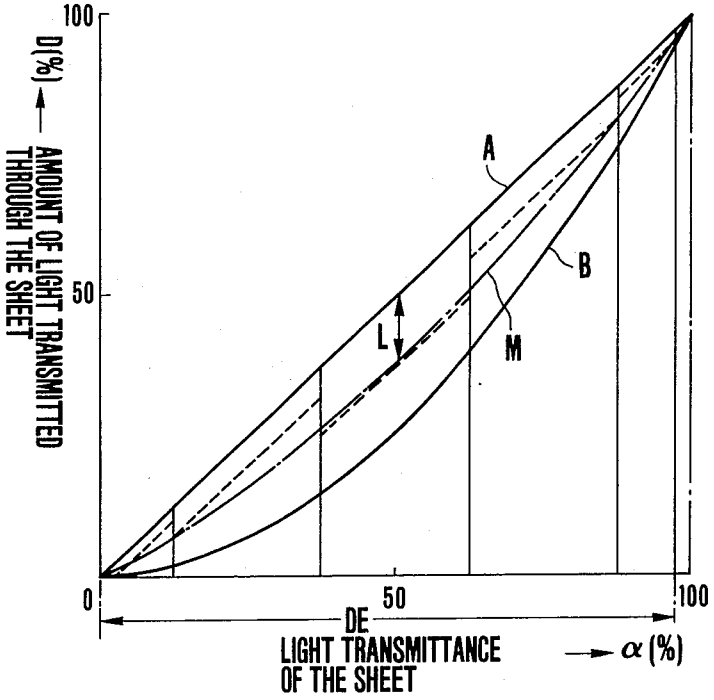
FIGS. 4 and 5 are respectively graphs for explaining the principle of double sheet detection according to the present invention.
Figure 3:
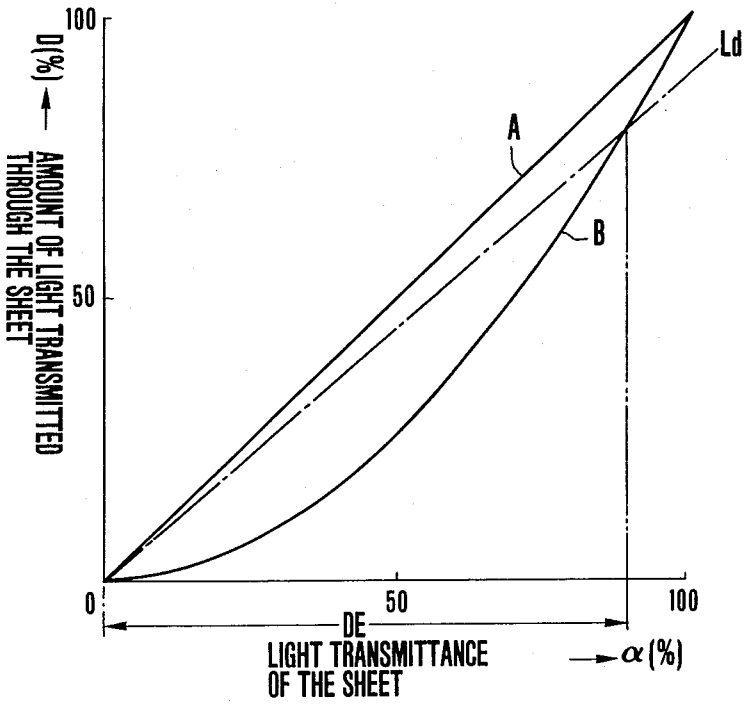
FIG.3 PRIOR ART

FIG. 4 shows the relationship between a transmittance $\alpha$ of light through a sheet and an amount D of light transmitted through the sheet in the same manner as in FIGS. 1 to 3. It should be noted again that the amount of light is expressed as a percentage where an amount of light which corresponds to 100% of transmittance is given to be 100%.

Referring to FIG. 4, a curve representing an intermediate value M between a theoretical amount D (represented by a line A) of light transmitted through one sheet and a theoretical amount D (represented by a curve B) of light transmitted through two sheets is given to be $D=(\alpha-\alpha^2)/2$. A reference value L is given which represents a difference between the value represented by the line A and the intermediate value M. The reference value L is given as a detection level Ld.

The reference value L is preset in accordance with the corresponding amount D of light. A difference S between the amount $D(n-1)$ of light transmitted through the immediately preceding sheet and the amount Dn of light transmitted through the current sheet is given by $D(n-1)-Dn$. When a condition $S \geqq L$ is established, a double sheet detection apparatus can detect that two sheets of the given type are simultaneously fed. Therefore, a detectable range DE can be widened so as to substantially correspond to the transmittance range from 0% to 100%. In addition, the difference S and the reference value L are sufficiently smaller than the amount D of light and the intermediate value for a large transmittance $\alpha$. As a result, a comparator having a narrow input range can be used.

As indicated by dotted lines, the intermediate values can be approximated by straight lines with regions of the detectable range for transmittance $\alpha$ so as to obtain the same result as described above.

Figure 5:
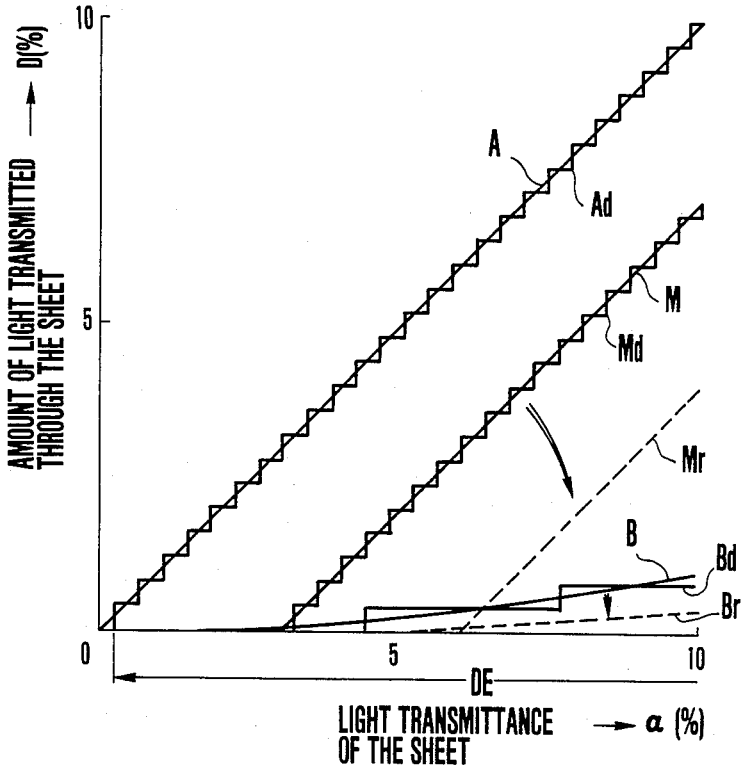

FIG. 5 is a graph showing a low transmittance range in an enlarged manner. When the sheet has a low transmittance $\alpha$, overlying sheets are detected to have a lower value (indicated by a curve Br) than a theoretical value (indicated by a curve B) due to light reflection between the overlying sheets. Therefore, the actual intermediate value must change from M to Mr when the sheet has a low transmittance. The reference value L is preferably determined in accordance with the value Mr.

It should be noted that reference symbols Ad, Md, Bd and so on in FIG. 5 are quantized data.

Figure 6:
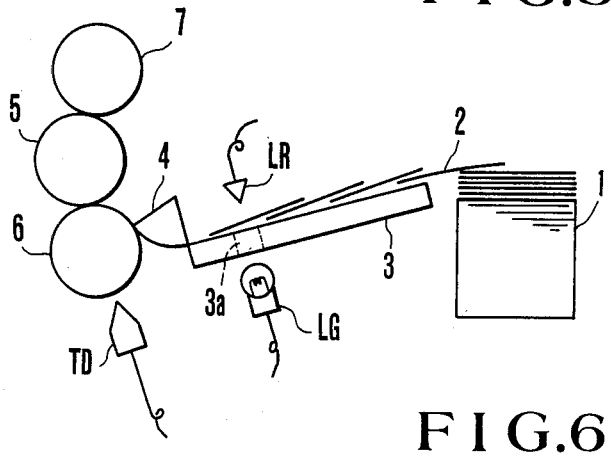
FIG. 6 is a block diagram showing the overall construction of a sheet-fed rotary press to which the present invention is applied.

FIGS. 6 to 10 show an embodiment of the invention which is based on the principle described above. FIG. 6 shows a schematic configuration of a sheet-fed rotary press to which the present invention is applied. A sheet 2 is fed from a feeding table 1 to a feedboard 3. The leading end of the sheet 2 is gripped by grippers 4, and the sheet 2 is fed between a blanket cylinder 5 and an impression cylinder 6. An image transferred from a plate cylinder 7 to the blanket cylinder 5 is printed on the sheet 2. A through hole 3*a* is formed in the vicinity of the distal end of the feedboard 3. Light emitted from a light source LG disposed below the lower surface of the feedboard 3 passes through the sheet 2. Light transmitted through the sheet 2 is received by a photosensor LR. The light received by the photosensor LR is converted into an electrical signal.

Drive members such as projections (not shown) are formed on the surface of the impression cylinder 6. A detector TD such as a proximity switch is arranged to oppose the impression cylinder 6 and detects rotation thereof. The detector TD generates a pulse signal in synchronism with rotation of the impression cylinder and hence operation of the rotary press.

Figure 7:
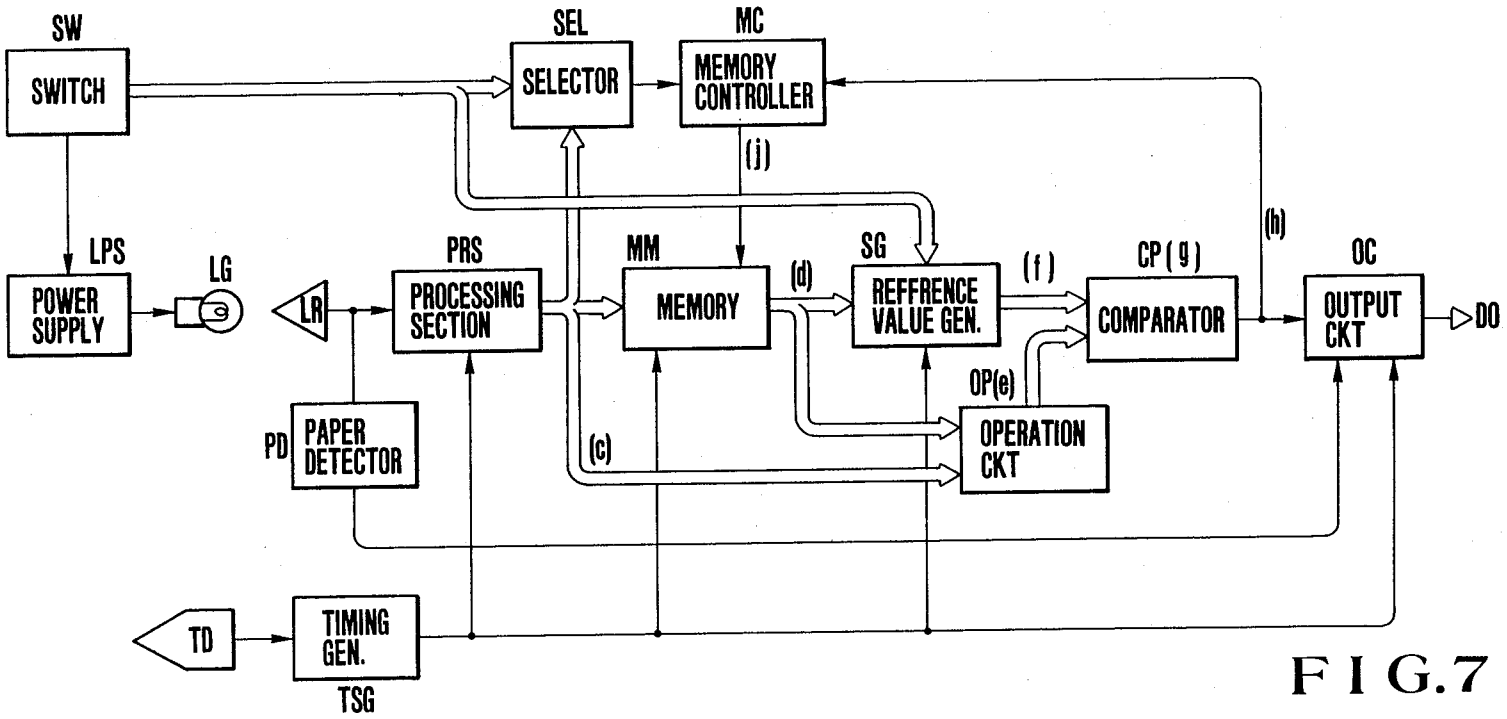
FIG. 7 is a block diagram of a double sheet detection apparatus according to an embodiment of the present invention.

FIG. 7 is a block diagram of a double sheet detection apparatus used for the sheet-fed rotary press described above.

The light source LG is turned on by a power supply LPS, and an output from the photosensor LR is supplied to a processing section PRS and is converted to a digital signal. This digital signal is supplied to a selector having a decoder or the like, a memory MM having a latch circuit or the like and an operation circuit OP having a subtractor or the like.

The operation circuit OP subtracts an output of the processing section PRS which represents the amount of light transmitted through the current sheet from an output of the memory MM which represents the amount of light transmitted through the immediately preceding sheet. A subtracted result or difference is supplied to a comparator CP. The comparator CP also receives an output from a reference value generator SG having a memory or the like. An output from the comparator CP is generated as a double sheet detection output DO through an output circuit OC such as an AND gate.

A selector SEL generates an output when the output from the processing section PRS falls outside a predetermined range. The output from the selector SEL is supplied to the memory MM through a memory controller MC such as an OR gate, thereby preventing the memory MM from storing the output from the processing section PRS. The output from the comparator CP is also supplied to the memory MM through the memory controller MC so as to prevent the memory MM from storing the output of the processing section PRS.

The output from the photosensor LR is also supplied to a paper detector PD using a Schmitt trigger circuit. When the output from the photosensor LR falls below a predetermined level, the paper detector PD generates a signal. This signal is supplied to the output circuit OC. At the same time, a timing signal generated from a timing signal generator TSG in synchronism with the output from the detector TD is supplied to the output circuit OC. When these two signals coincide, the output circuit OC is turned on, thereby gating the output from the comparator CP.

It should be noted the timing signal generator TSG generates various timing signals which are supplied to the processing section PRS, the memory MM, and the reference value generator SG, thereby controlling the operation timings of the components of the double sheet detection apparatus.

A switch SW is arranged to be switched in accordance with the types of sheets 2. The switch SW controls the power supply LPS to vary the luminous intensity of the light source LG. At the same time, the switch SW controls the selector SEL and the reference signal generator SG so as to vary a predetermined range of the output from the processing section PRS monitored by the selector SEL and to vary a range of the reference values L each represented by the output from the reference value generator SG.

Figure 8:
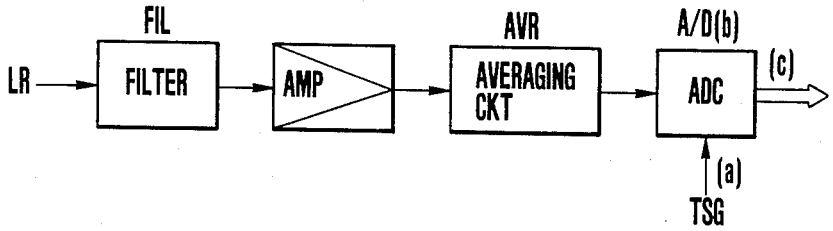
FIG. 8 is a block diagram showing the detailed arrangement of a processing section shown in FIG. 7.

FIG. 8 is a block diagram showing the detailed arrangement of the processing section PRS. The output from the photosensor LR is supplied to a filter FIL. The filter FIL removes a noise component from the output generated by the photosensor LR. The filtered output is amplified by an amplifier AMP to a predetermined level. The amplified output is averaged by an averaging circuit AVR including an integrator. The averaged output is converted by an analog-to-digital converter (to be referred to as an ADC hereinafter) A/D to a digital signal in response to the timing signal from the timing signal generator TSG.

Figure 9:
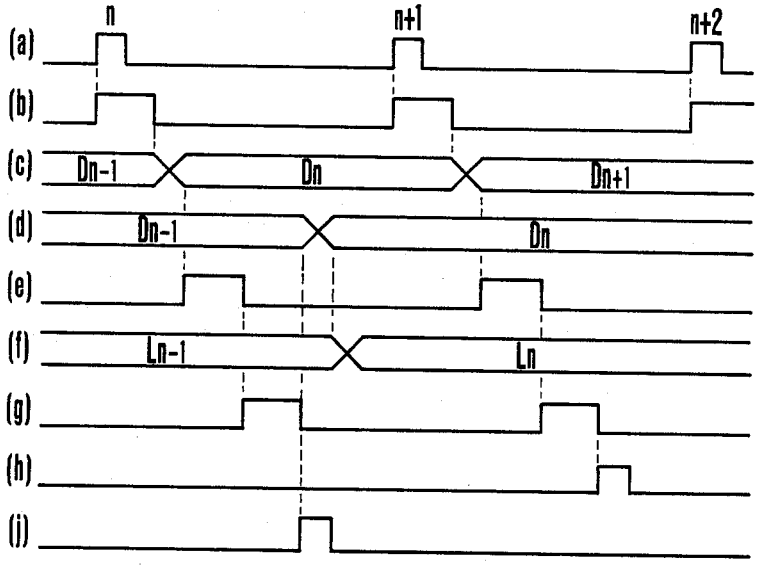
FIG. 9 is a timing chart for explaining the operations of the respective components in FIGS. 7 and 8.

FIG. 9 is a timing chart showing the waveforms and operations of the respective components of FIGS. 7 and 8. When the nth timing signal (a) is generated in synchronism with the feeding of the current sheet 2, A/D conversion (b) is performed. When the A/D conversion is completed, a digital signal (c) representing Dn is supplied to one input terminal of the operation circuit OP.

In this case, the content of the memory MM is given as the amount $D(n-1)$ for the immediately preceding sheet 2. The readout data $D(n-1)$ is supplied to the other input terminal of the operation circuit OP. A calculation (e) is performed such that $D(n-1)-Dn=S(n-1)$. The comparator CP performs a comparison operation (g) between the calculated result $S(n-1)$ with an output (f) representing the reference value $L(n-1)$ corresponding to the output $D(n-1)$ from the reference value generator SG.

When the sheet 2 is detected as a single sheet, i.e., when a condition $S(n-1)<L(n-1)$ is established, the comparison output (h) is not generated. In synchronism with this comparison operation, the memory controller MC generates a strobe pulse (j). The content of the memory MM is updated to Dn in response to the strobe pulse. In addition, the output (f) from the reference value generator SG is also updated to the reference value Ln.

When the $(n+1)$th timing signal (a) is generated in synchronism with the next sheet 2, the same operation as described above is repeated. In this case, when two overlying sheets are fed, the comparison operation (g) detects the condition $Sn \geqq Ln$, thereby generating the comparison output (h) as the detection output DO. The strobe pulse (j) is not generated which prevents the content of the memory MM and the reference value Ln from being updated.

It should be noted that the reference value is generated such that the reference values corresponding to the amounts D of light are stored at the respective addresses of the memory, upper address bits are designated by the switch SW to restrict the range of the reference values, and lower address bits are designated by the output from the memory MM, thereby reading out the storage content of any desired address.

Figure 10:
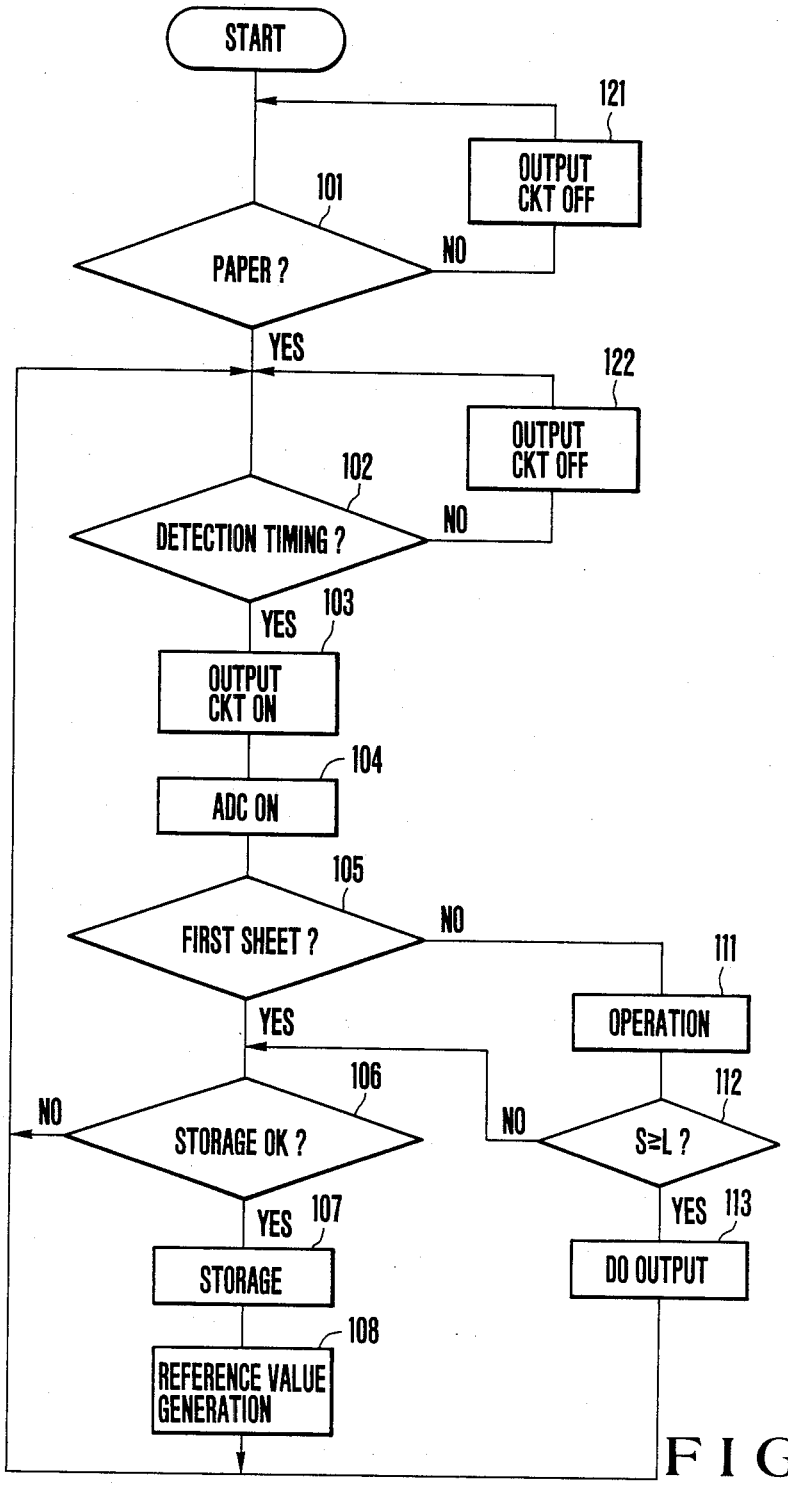
FIG. 10 is a flow chart for explaining the operation of the double sheet detection apparatus shown in FIG. 7.

FIG. 10 is a flow chart for explaining the operation of the double sheet detection apparatus shown in FIG. 7. In step 101 it is determined whether or not the paper detector PD detects that "paper is present", and in step 102 it is determined whether or not the timing signal indicates a "detection timing". If YES in these steps, the output circuit is turned on in step 103. In step 104, ADC operation is performed such that the processing section PRS converts the amount D of light transmitted through the sheet 2 into a digital signal to be sent out therefrom. In step 105 it is determined whether or not the sheet 2 is detected "first". If YES in step 105, in step 106 the selector SEL determines whether or not the amount D falls within the predetermined range. If YES in step 106, the memory controller MC generates the strobe pulse. The "storage" operation is performed by the memory MM in step 107. In accordance with the storage content of the memory MM, the reference value generator SG performs "reference value generation" in step 108. The flow returns to step 102, and the same operation as described above is repeated.

If NO in step 106, steps 107 and 108 are not performed, and the flow directly returns to step 102.

If NO in step 105, an operation "$D(n-1)-Dn=S$" is performed in step 111. The comparator CP then checks whether or not a condition "$S \geqq L$" is established in step 112. If YES in step 112, "detection output generation" is performed in step 113, and the flow returns to step 102.

If NO in step 112, the flow returns to step 106 and to step 102 through steps 106 and 107.

If NO in steps 101 and 102, the output circuit is turned "off" in steps 121 and 122.

The above operation is repeated to automatically set the optimal reference values L in accordance with the amounts D of light transmitted through the sheets 2. Double sheet detection is then performed in accordance with a currently detected amount and its corresponding value. As a result, the principle shown in FIG. 4 can be properly realized.

The detector TD may comprise a rotary encoder. The reference value generator SG, the operation circuit OP, the memory MM, the comparator CP, the selector SEL and the memory controller MC may be replaced with a microprocessor and a memory. In addition to these modifications, an analog circuit may be utilized to provide the same function as the apparatus shown in FIG. 7. Other modifications and changes may be made within the spirit and scope of the present invention.

As is apparent from the above embodiment of the present invention, the optimal reference value can be automatically updated, so influences due to a change in transmittance of the sheet and other changes in detection conditions can be eliminated, thereby providing proper double sheet detection. In addition, since the reference value and the light amount difference value are small, a low-cost comparator having a narrow input range can be used with high precision. Thus, great advantages are obtained for various types of sheet-fed rotary presses.

What is claimed is:

1. A double sheet detection method for a sheet-fed rotary press, comprising the steps of:

setting a theoretical reference value as a difference between a first theoretical amount of light transmitted through one sheet and an intermediate value; said intermediate value lying between said first theoretical amount of light transmitted through one sheet and a second theoretical amount of light transmitted through two sheets;

storing the theoretical reference value in correspondence with the amount of light transmitted through a sheet;

calculating a difference between an amount of light transmitted through a first sheet and an amount of light transmitted through a second sheet when actual printing is performed;

reading out the theoretical reference value which corresponds to the amount of light transmitted through the first sheet and which is defined as an actual reference value;

comparing the difference obtained in the calculating step with the actual reference value; and performing double sheet detection in accordance with a comparison result.

2. A method according to claim 1, wherein the intermediate value is approximated with straight lines within a detectable range of light transmitted through the sheet.

3. A method according to claim 1, wherein the intermediate value is set at a predetermined low value when the sheet has a low transmittance.

4. A double sheet detection apparatus for a sheet-fed rotary press, comprising:

a light-emitting element and a light-receiving element, opposing each other through a sheet, for generating an analog signal representing an amount of light received;

a processing section for receiving the analog signal from said light-receiving element and converting the analog signal into a digital signal;

a memory for receiving the digital signal from said processing section and storing the digital signal therein;

an operation circuit for receiving the digital signals from said memory and said processing section and calculating a difference therebetween;

a reference value generator for storing a difference between the amount of light transmitted through one sheet and an intermediate value, said intermediate value lying between the amount of light transmitted through one sheet and the amount of light transmitted through two sheets and for generating the difference value as a reference value in response to the digital signal from said memory;

a comparator for receiving and comparing output signals from said reference value generator and said operation circuit and for generating a signal representing a comparison result;

an output circuit for generating as a double sheet detection signal the signal generated from said comparator; and a timing signal generator for supplying timing signals for controlling operation timings of said processing section, said memory, said reference value generator and said output circuit.

5. An apparatus according to claim 4, further comprising a paper detector for supplying a sheet detection signal to said output circuit when an output from said light-receiving element is smaller than a specific value and for causing said output circuit to generate the double sheet detection signal in response to one of the timing signals from said timing signal generator and the output from said comparator.

6. An apparatus according to claim 4, further comprising:

a selector for receiving the digital signal from said processing section and generating a signal representing that a level thereof falls outside a predetermined range;

a memory controller for receiving output signals from said selector and said comparator and generating a signal for inhibiting a storage operation of said memory; and a switch for switching an intensity of light emitted by said light-emitting element and controlling said selector and said reference value generator in accordance with a type of sheet.

* * * * *